US012092439B2

(12) United States Patent
Jones et al.

(10) Patent No.: US 12,092,439 B2
(45) Date of Patent: Sep. 17, 2024

(54) SMALL CALIBER PRODUCTION AMMUNITION MACHINE WITH NOVEL MEASURING LOCATION AND DEVICE

(71) Applicant: Bitterroot Tool & Machine Inc., Stevensville, MT (US)

(72) Inventors: Randy J. Jones, Stevensville, MT (US); Jeff C. Hritcu, Stevensville, MT (US)

( * ) Notice: Subject to any disclaimer, the term of this patent is extended or adjusted under 35 U.S.C. 154(b) by 0 days.

(21) Appl. No.: 17/592,363

(22) Filed: Feb. 3, 2022

(65) Prior Publication Data

US 2022/0325997 A1 Oct. 13, 2022

Related U.S. Application Data

(60) Provisional application No. 63/145,339, filed on Feb. 3, 2021.

(51) Int. Cl.

| | |
|---|---|
| ***F42B 35/00*** | (2006.01) |
| ***F42B 33/00*** | (2006.01) |
| ***F42B 33/02*** | (2006.01) |
| ***F42B 35/02*** | (2006.01) |

(52) U.S. Cl.

CPC ..... *F42B 33/004* (2013.01); *F42B 33/005* (2013.01); *F42B 33/0285* (2013.01); *F42B 35/02* (2013.01)

(58) Field of Classification Search

CPC ..... F42B 33/00; F42B 33/001; F42B 33/004; F42B 33/005; F42B 33/02; F42B 33/0285

See application file for complete search history.

(56) References Cited

U.S. PATENT DOCUMENTS

| | | | | | |
|---|---|---|---|---|---|
| 2,341,292 | A * | 2/1944 | Reynolds | B07C 5/06 | 209/940 |
| 2,600,488 | A * | 6/1952 | Crump | F42B 33/001 | 33/506 |
| 2,719,453 | A * | 10/1955 | Bahler | F42B 33/005 | 86/43 |
| 3,001,436 | A * | 9/1961 | Deitemeyer | F42B 33/004 | 86/25 |
| 3,138,056 | A * | 6/1964 | Covey | F42B 33/001 | 86/39 |
| 3,153,976 | A * | 10/1964 | Linder | F42B 33/004 | 86/26 |
| 3,204,518 | A * | 9/1965 | Jackson | F42B 33/001 | 86/43 |
| 3,319,511 | A * | 5/1967 | McLean | F42B 33/002 | 86/44 |
| 3,450,000 | A * | 6/1969 | Ponsness | F42B 33/004 | 86/25 |

(Continued)

*Primary Examiner* — Derrick R Morgan

(74) *Attorney, Agent, or Firm* — Mitchell J. W. Vap

(57) ABSTRACT

Herein described is a small caliber ammunition production loading machine with a novel measuring location and device. The machine will load one cartridge at a time and is referred to as a 'single-out" machine (see FIG. 1). The machine will be similar in nature to existing loading machines with the following key novel aspects: a) The cartridge overall length (OAL) will be measured both as an overall dimension which is industry standard and also at a key datum location on a bullet's ogive. Measuring to a repeatable datum point on the bullet's ogive gives a more accurate representation of the cartridge's ballistic ability.

3 Claims, 12 Drawing Sheets

(56) References Cited

U.S. PATENT DOCUMENTS 3,796,127 A * 3/1974 Deitemeyer ..... F42B 33/004 86/36
3,857,319 A * 12/1974 Welch ..... F42B 33/004 86/36
4,116,109 A * 9/1978 Ervine ..... F42B 33/004 74/820
4,127,054 A * 11/1978 Gully ..... F42B 33/0285 86/29
4,385,546 A * 5/1983 Lee ..... F42B 33/005 86/36
4,425,833 A * 1/1984 Purdie ..... F42B 33/002 86/44
4,522,102 A * 6/1985 Pickens ..... F42B 33/004 86/27
4,862,567 A * 9/1989 Beebe ..... F42B 33/005 86/43
4,869,148 A * 9/1989 Tucker ..... F42B 33/001 86/39
5,024,135 A * 6/1991 Bender ..... F42B 33/004 86/27
5,079,986 A * 1/1992 Lee ..... F42B 33/005 86/39
5,570,513 A * 11/1996 Peterson ..... F42B 35/02 33/506
5,900,574 A * 5/1999 Hart ..... F42B 33/004 86/39
6,772,668 B2 * 8/2004 Shields ..... F42B 33/004 86/44
7,383,152 B1 * 6/2008 Moore ..... G01B 11/002 702/159
7,681,481 B1 * 3/2010 Buckley ..... F42B 33/005 86/26
7,703,369 B1 * 4/2010 Lee ..... F42B 33/10 86/43
10,655,944 B1 * 5/2020 Gent ..... F42B 33/002
10,935,356 B1 * 3/2021 Steven ..... F42B 33/002
11,561,076 B2 * 1/2023 Jones ..... F42B 33/004
2006/0180011 A1 * 8/2006 Benn ..... F42B 33/02 86/27
2009/0013859 A1 * 1/2009 de Almeida ..... F42B 33/004 86/24
2010/0122624 A1 * 5/2010 Jackson ..... F42B 33/10 86/23
2013/0139675 A1 * 6/2013 Baxter ..... F42B 33/0207 86/31
2016/0040969 A1 * 2/2016 Kleinschmit ..... F42B 33/001 86/43
2016/0084624 A1 * 3/2016 Pruett ..... F42B 33/004 86/23
2018/0164085 A1 * 6/2018 Mandelli ..... F42B 33/10
2019/0368848 A1 * 12/2019 Carter ..... F42B 33/001
2020/0217634 A1 * 7/2020 Pruett ..... F42B 33/001
2020/0309501 A1 * 10/2020 Gent ..... F42B 35/02
2020/0363179 A1 * 11/2020 Overton ..... F42B 3/00
2020/0393228 A1 * 12/2020 Burke ..... F42B 33/0285
2021/0055090 A1 * 2/2021 Trimpe ..... B21D 3/16
2021/0278184 A1 * 9/2021 Beach ..... F42B 5/307

* cited by examiner

SMALL CALIBER PRODUCTION AMMUNITION MACHINE WITH NOVEL MEASURING LOCATION AND DEVICE

CROSS-REFERENCE TO RELATED APPLICATIONS

This is a U.S. Nonprovisional Application, which claims priority from U.S. Provisional Application No. 63/145,339 filed Feb. 3, 2021, the disclosure of which is hereby incorporated by reference in its entirety to provide continuity of disclosure.

STATEMENT REGARDING FEDERALLY SPONSORED RESEARCH OR DEVELOPMENT

Not Applicable

THE NAMES OF THE PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

Herein described is a small caliber ammunition production loading machine with a novel measuring location and device. The machine will load one cartridge at a time and is referred to as a 'single-out" machine. The machine will be similar in nature to existing loading machines with the following key novel aspects: a) The cartridge overall length (OAL) will be measured both as an overall dimension which is industry standard and also at a key datum location on a bullet's ogive. Measuring to a repeatable datum point on the bullet's ogive gives a more accurate representation of the cartridge's ballistic ability.

There are basically three types of bullet ogive configurations: tangent, secant and hybrid ogive (FIG. 6 prior art). The ogive is the point on the radius where the curve of the nose of the bullet contacts the front of the full diameter (caliber diameter) of the bullet. If the radius is tangent to the full diameter, it provides a smooth juncture with the bearing surface and is good for self-aligning the bullets into the barrel rifling, therefore making the bullet less sensitive to seating depth. However, the tangent bullet has more drag. The secant bullet has less drag, however the abrupt juncture between the bearing surface and the ogive is not good for self-aligning and is more sensitive to seating depth. The hybrid bullets combine the low drag of the secant ogive with the tangent intermediate area between the ogive and the bearing diameter to get a lower drag bullet with self-aligning properties. By knowing the style of bullet being used and selecting the same point on the bullet ogive, the seating depth will stay consistent. The bullet's ogive is the first point of contact with the barrels spiral rifling and so controlling that height more consistently will control the accuracy and consistency of the loaded ammunition.

BRIEF SUMMARY OF THE INVENTION

The overall function of the machine is set forth below. The machine's purpose is to precisely load a complete cartridge at a minimum of 100 parts per minute. The primary stations to create a completed cartridge are:

1) Case Load Station—comprised of the case collator, case feed assembly with case sensors, case inserts, and insert disk.
2) Powder Load Station—comprised of the powder hopper, powder slides, powder delivery tubes, powder shuttle located above the machine, physical powder sensor and a laser powder measuring check.
3) Bullet Load Station—comprised of the bullet collator, bullet feed assembly, bullet latch, and bullet punch integral with the bullet feed assembly and activated by the upper ram.
4) Case Bullet Crimp Station—comprised of the upper ram driven crimp tool and the case inserts.
5) Process Control station—comprised of an OAL laser height check and ogive length check.
6) Reject Station—based on the OAL and ogive length, this will remove the assembled case from the disk before the eject station with a pneumatic cylinder.
7) Eject Station—comprised of a pneumatically activated pusher to remove the cartridge assembly from the insert disk and drop onto an internal mounted conveyor. The empty insert is now ready to receive the next empty case for loading.

The machine will have an upper and lower ram connected by (8) vertical support rods. The rods are guided by bushed ball cages inside of (8) support towers. The motor drives a center mounted crankshaft with a chain, sprockets and clutch that drives the lower ram up and down.

The upper ram has special tool holders that act on the cartridges throughout the machines cycle to load the case, a bell mouth tool to confirm the case mouth is round and to the proper size, debris check that has a pin and sensor so that foreign contaminates in the empty cases are identified, load the powder, load the bullets and crimp the cases to the bullets. The two upper rams are supported by a bridge system to maintain rigidity.

The same motor that drives the rams also turns the indexer. This 24-position indexer then rotates the insert disk in a counterclockwise direction. The indexer is chain driven and has an overload relief sensor that will stop the machine if there is too much load on the chain. The insert disk carries the cases through each of the stations in order. The disk is protected by a spring and ball clutch system to avoid damage if a jam occurs.

BRIEF DESCRIPTION WITH SEVERAL VIEWS OF DRAWINGS

DETAILED DESCRIPTION OF THE INVENTION

Figure 1:
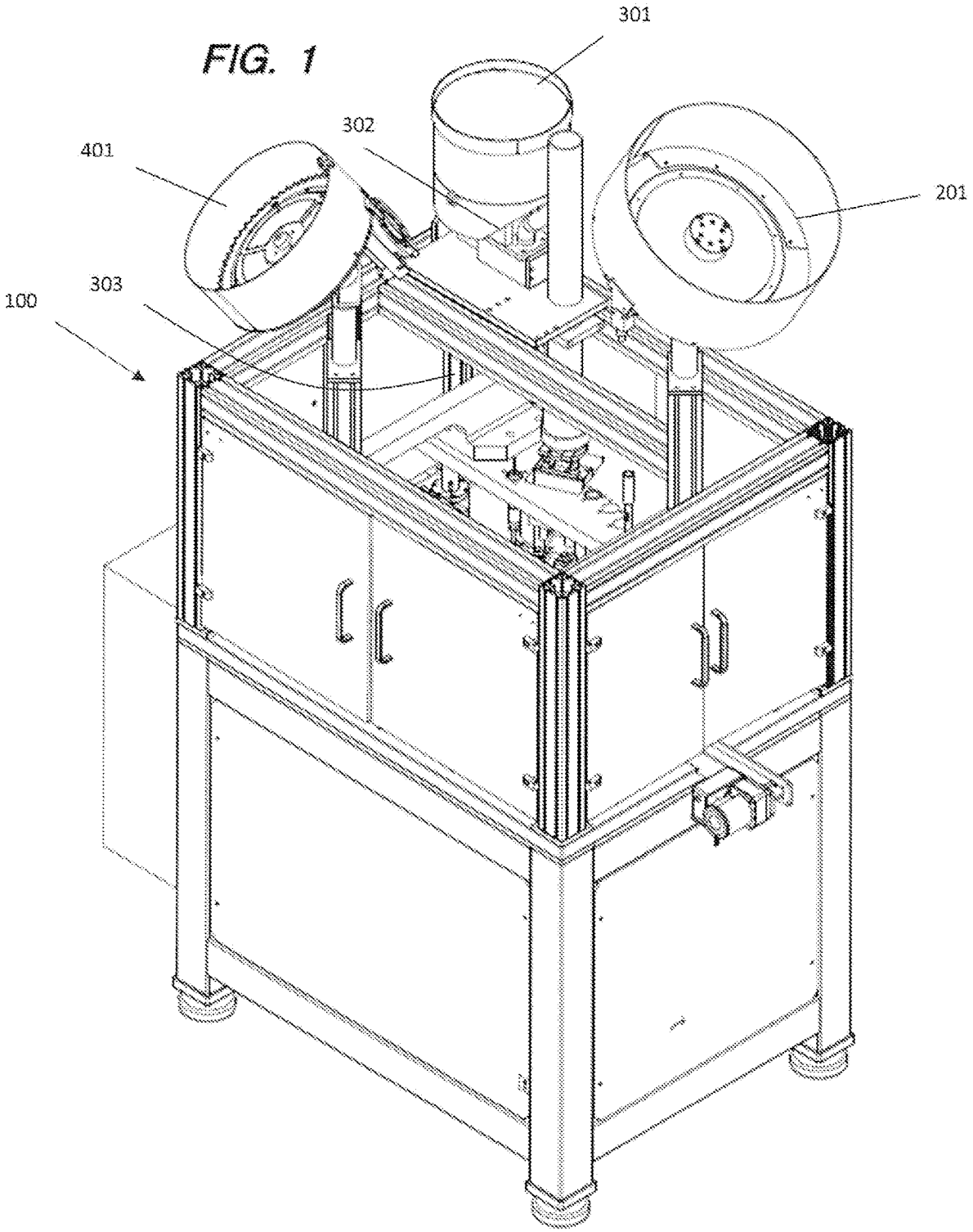
FIG. 1 is a perspective view of the overall machine assembly.
Figure 2A:
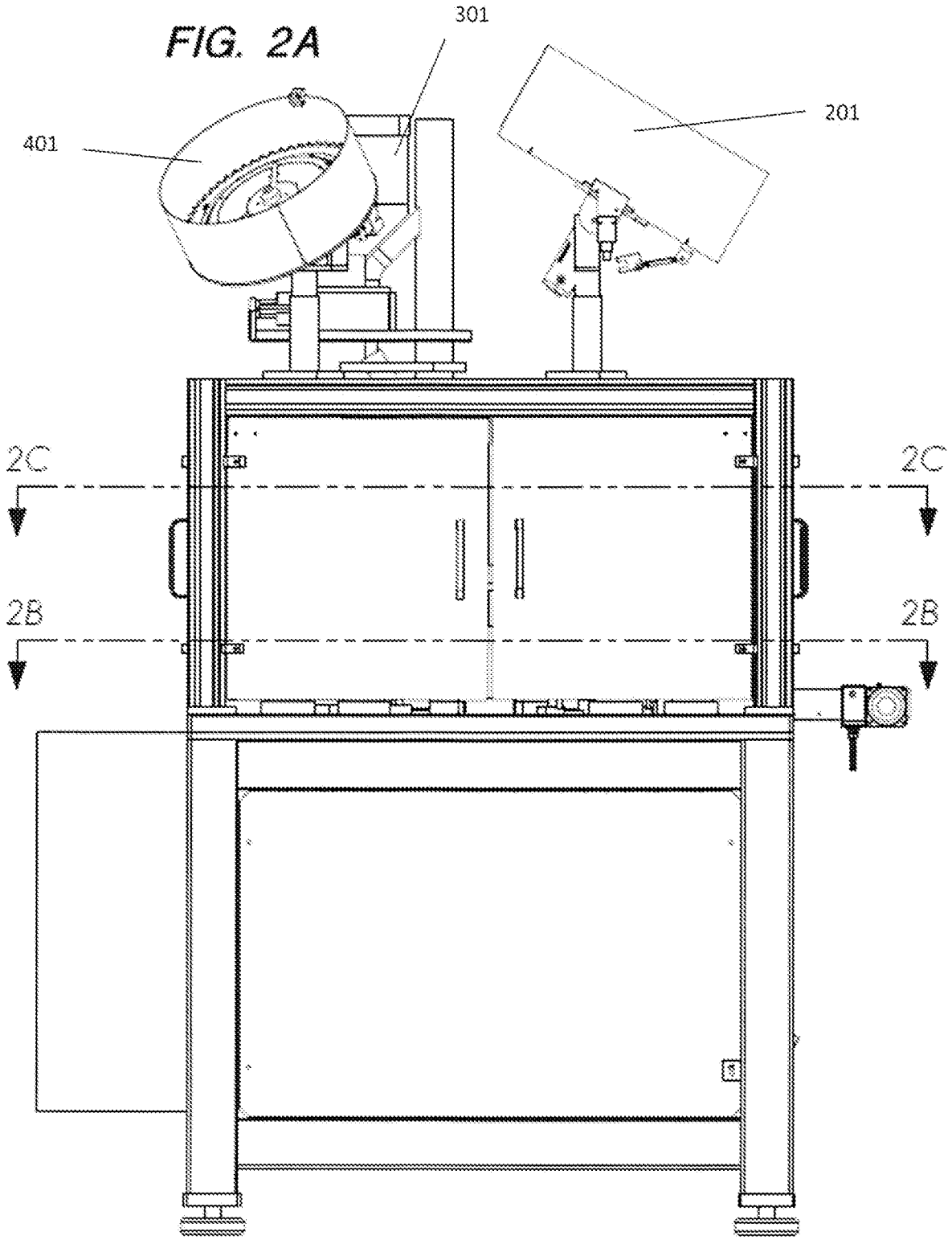
FIG. 2A is a side view of the overall machine assembly.
Figure 2B:
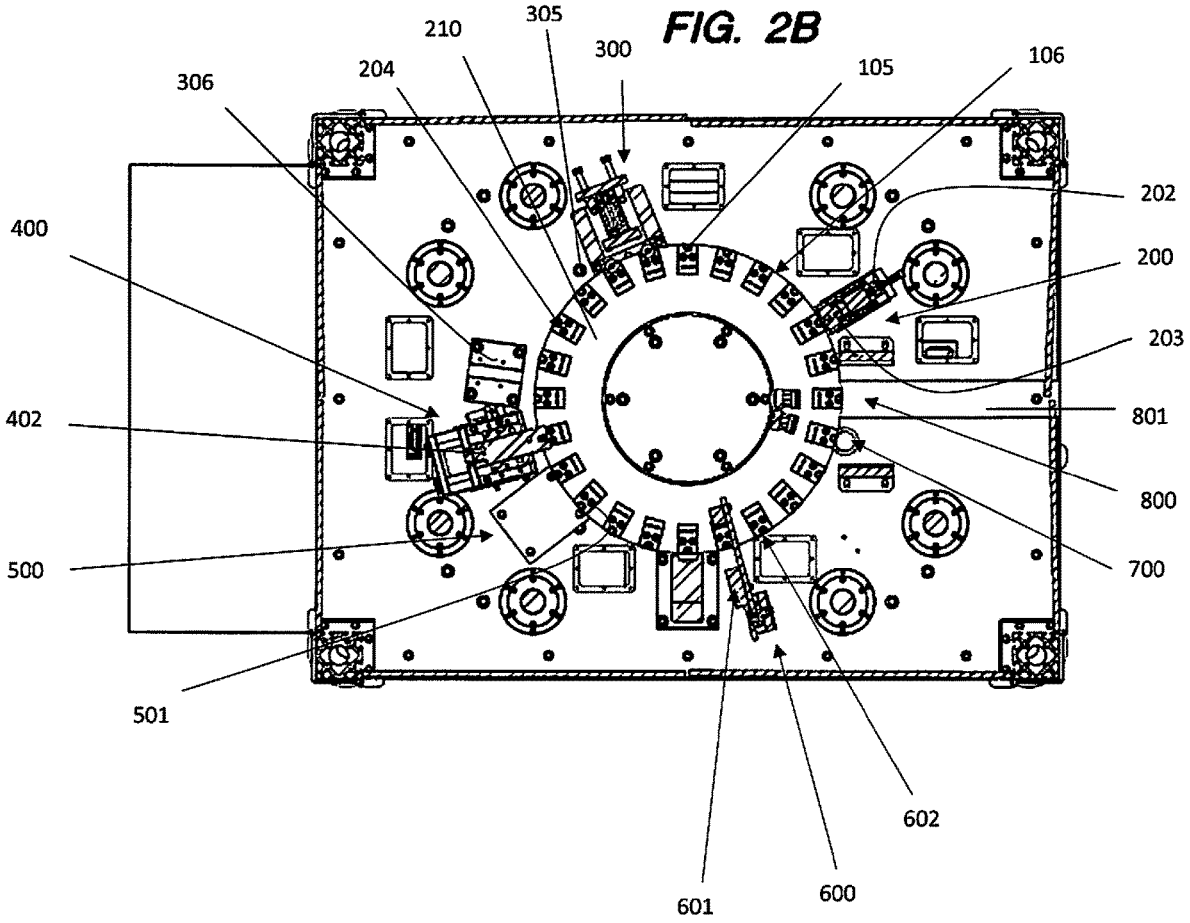
FIG. 2B is a an overhead cross section view of the various stations of the machine.
Figure 2C:
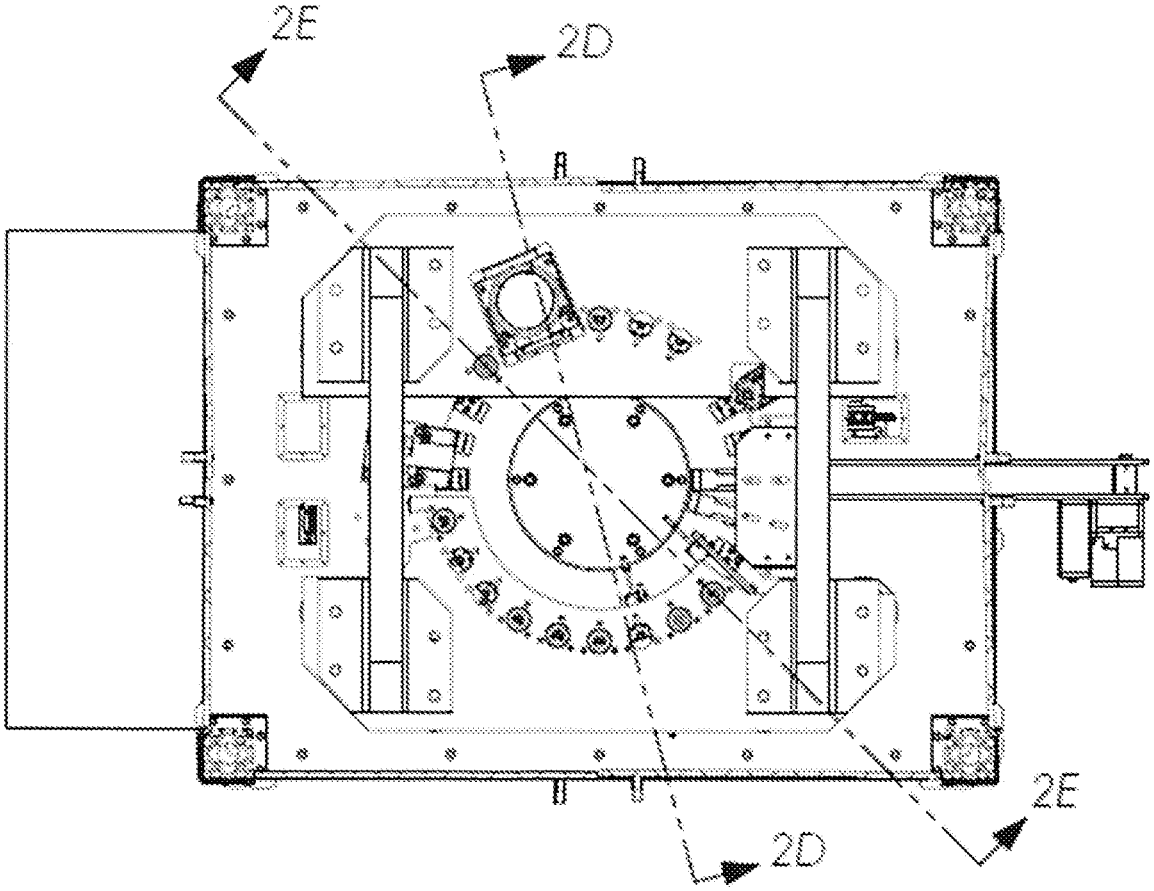
FIG. 2C is an over head cross section view of the machine to delineate location of the laser OAL station and ogive laser station within the machine.
Figure 2D:
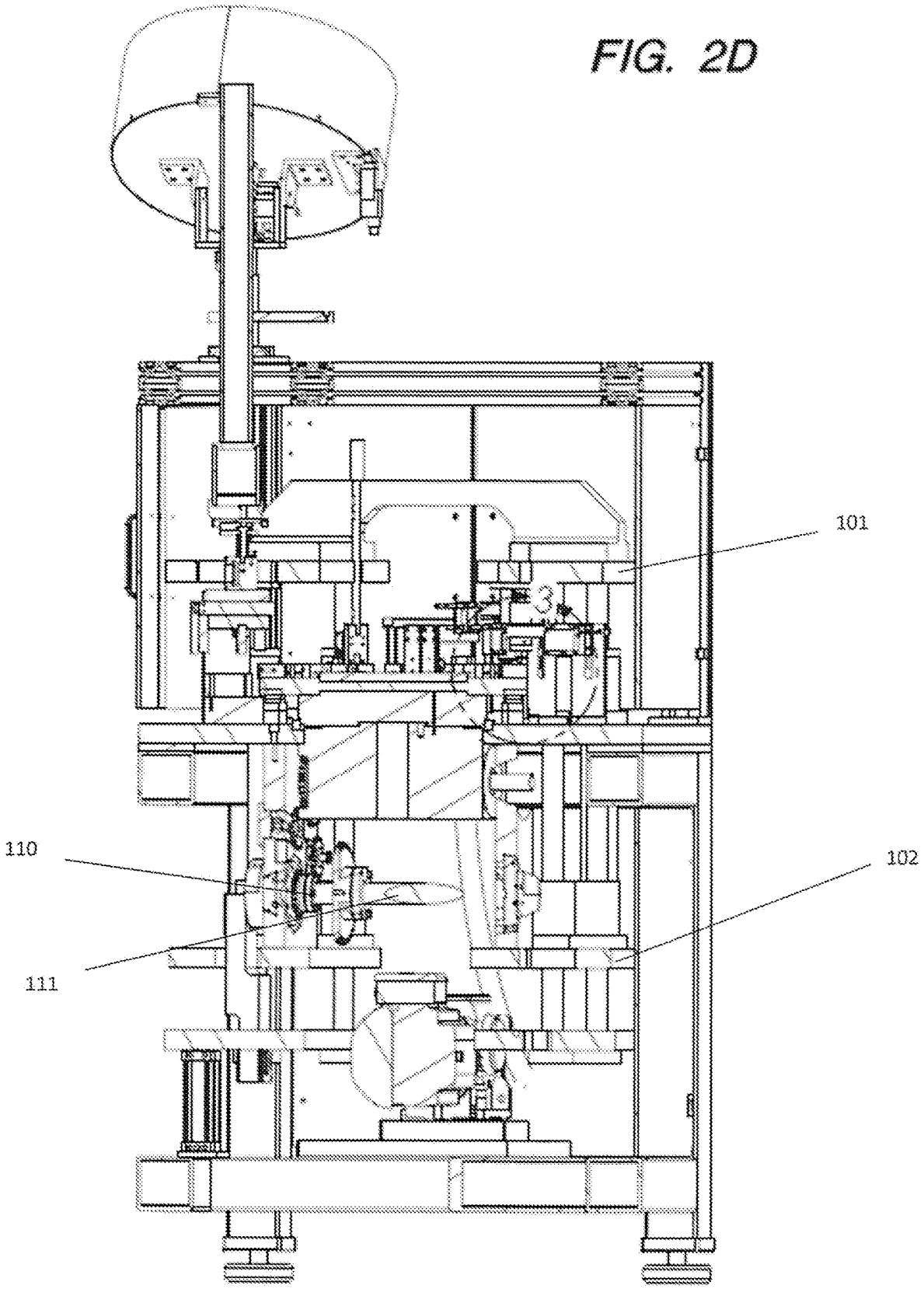
FIG. 2D is a side cross sectional view showing the laser OAL station.
Figure 2E:
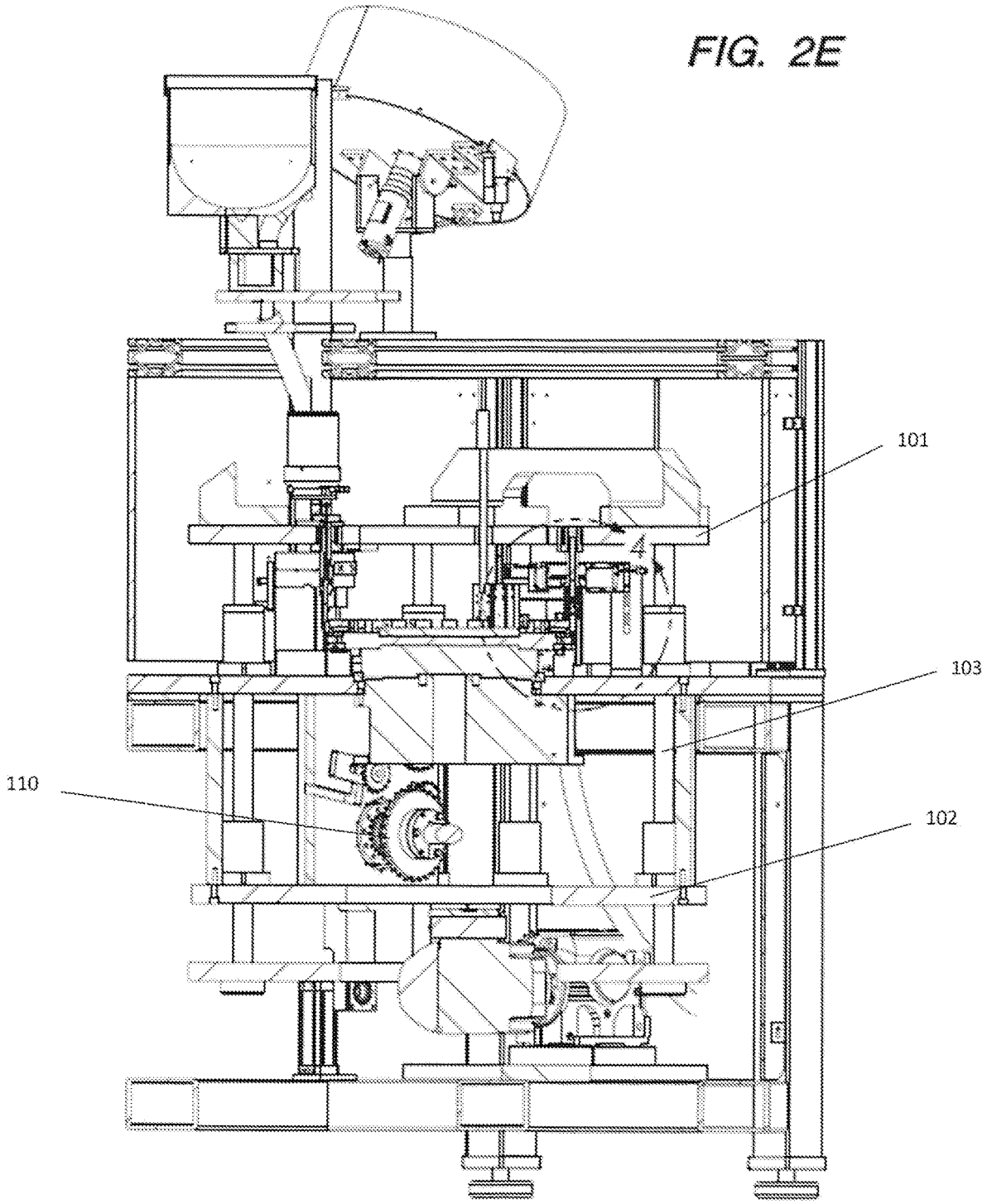
FIG. 2E is a side cross sectional view showing the ogive length station.

With reference to the attached drawings, the novel features of the machine are described more fully below.

The machine 100 is comprised of an upper ram 101 and lower ram 102 connected by (8) vertical support rods 103. The vertical support rods 103 are guided by bushed ball cages inside of (8) support towers. A motor 110 drives a center mounted crankshaft 111 with a chain, sprockets and clutch that drives the lower ram 102 up and down.

The upper ram 101 has special tool holders that act on the cartridges throughout the machine's 100 cycle to load a case 104. A bell mouth tool 105 is used to confirm the case 104 mouth is round and to the proper size. A debris check 106 is comprised of a pin and sensor to detect foreign contaminates in an empty case 104 are identified. Cases 104, which pass the debris check 106 proceed around the machine counterclockwise for powder loading, bullet loading and crimping of the cases 104 to bullets 107.

The same motor 110 that drives the rams also turns an indexer. This 24-position indexer rotates an insert disk 210 in a counterclockwise direction through the various machine processes. The indexer is chain driven and has an overload relief sensor that will stop the machine if there is too much load on the chain. The insert disk 210 carries the cases through each of the stations in order. The insert disk 210 is protected by a spring and ball clutch system to avoid damage if a jam occurs.

Further detail of the machine's 100 process stations is set forth below. The machine's 100 Case Load Station 200 is comprised of a case collator 201, case feed assembly 202 with case sensors 203, and an insert disk 210 which is further comprised of removeable case inserts 204, which are sized specifically to accept cases of specified ammunition and effectuate crimping of the cases 104 to the bullets 107. Cases 104 are placed into the case inserts 204 of the insert disk 210 and the counterclockwise rotation of insert disk 210 rotates the cases 104 through the subsequent stations of the machine 100.

Once inserted, cases 104 are rotated to the Powder Load Station 300. The Powder Load Station 300 is comprised of a powder hopper 301, powder slides 302, powder delivery tubes 303, a powder shuttle located above the machine 100, a physical powder sensor 305 and a laser powder measuring check 306. The physical powder sensor 305 and laser powder measuring check 306 are programmed to specific powder volumes per the ammunition specs being reloaded to ensure the proper amount of powder is being loaded into the cases 104.

Once powder is loaded, cases 104 are rotated to a Bullet Load Station 400. The Bullet Load Station 400 is comprised of a bullet collator 401, bullet feed assembly 402, bullet latch, and bullet punch integral with the bullet feed assembly 402 and activated by the upper ram 101. The Bullet Load Station 400 seats the bullets 107 in the cases 104.

Once the bullets 107 are seated in the cases 104 the loaded cases move to the Case Bullet Crimp Station 500. The Case Bullet Crimp Station 500 is comprised of the upper ram 101 driven bushing crimp tool 501, which pushes the bullets 104 loaded into said cases 104 down into said case inserts 204 to effectuate crimping of the case 104 to the bullet 107.

Figure 3:
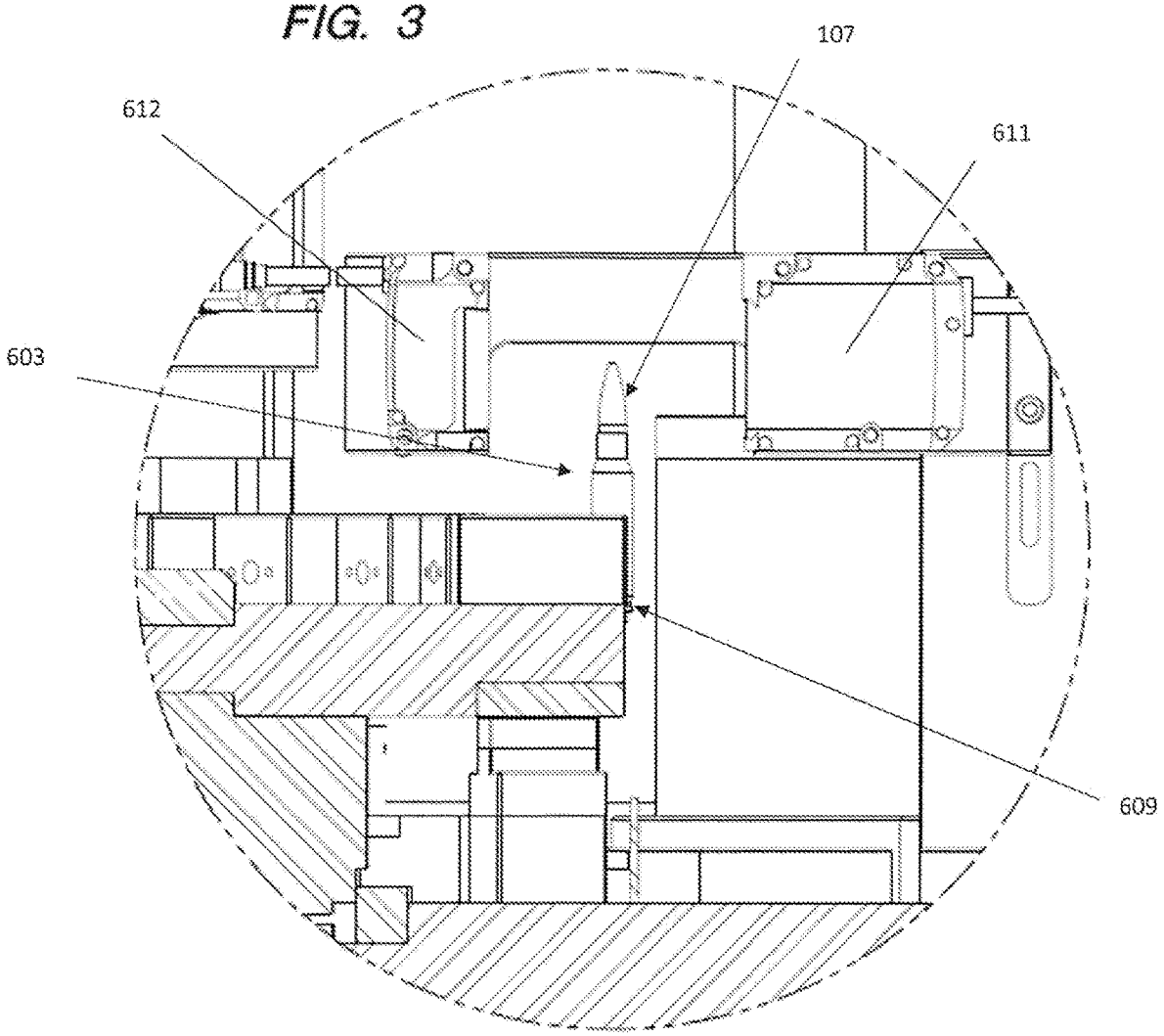
FIG. 3 is a cross section detail view of the laser OAL station of the machine.
Figure 4:
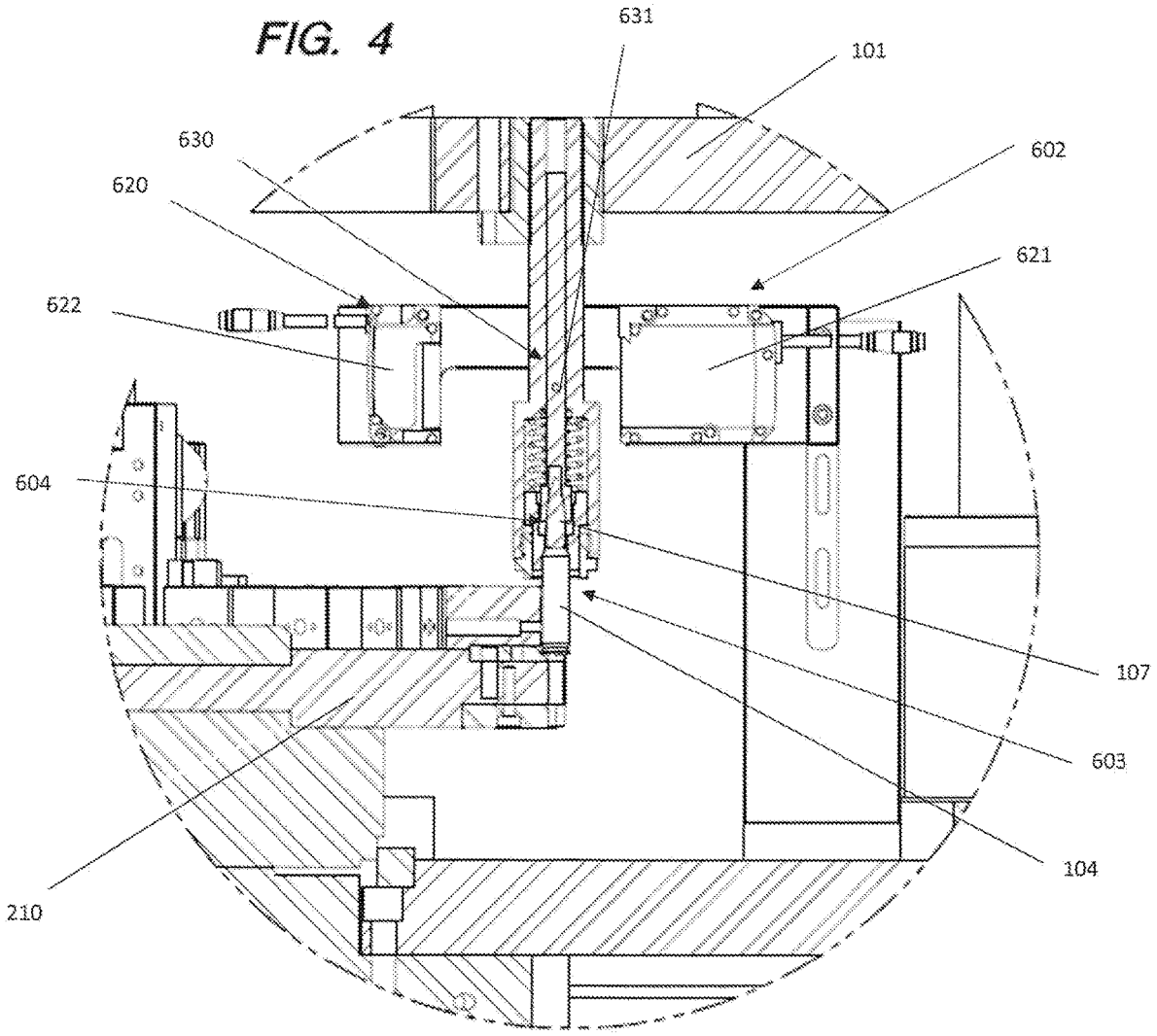
FIG. 4 is a cross section detail view of the ogive length station of the machine.
Figure 5A:
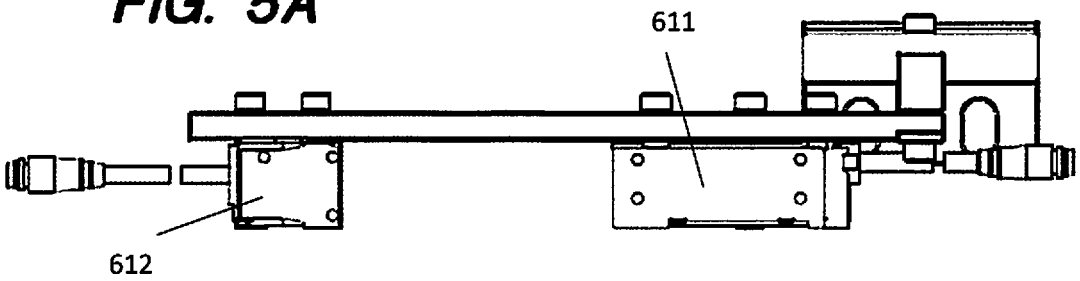
FIG. 5A is a top plan view of the laser OAL assembly.
Figure 5B:
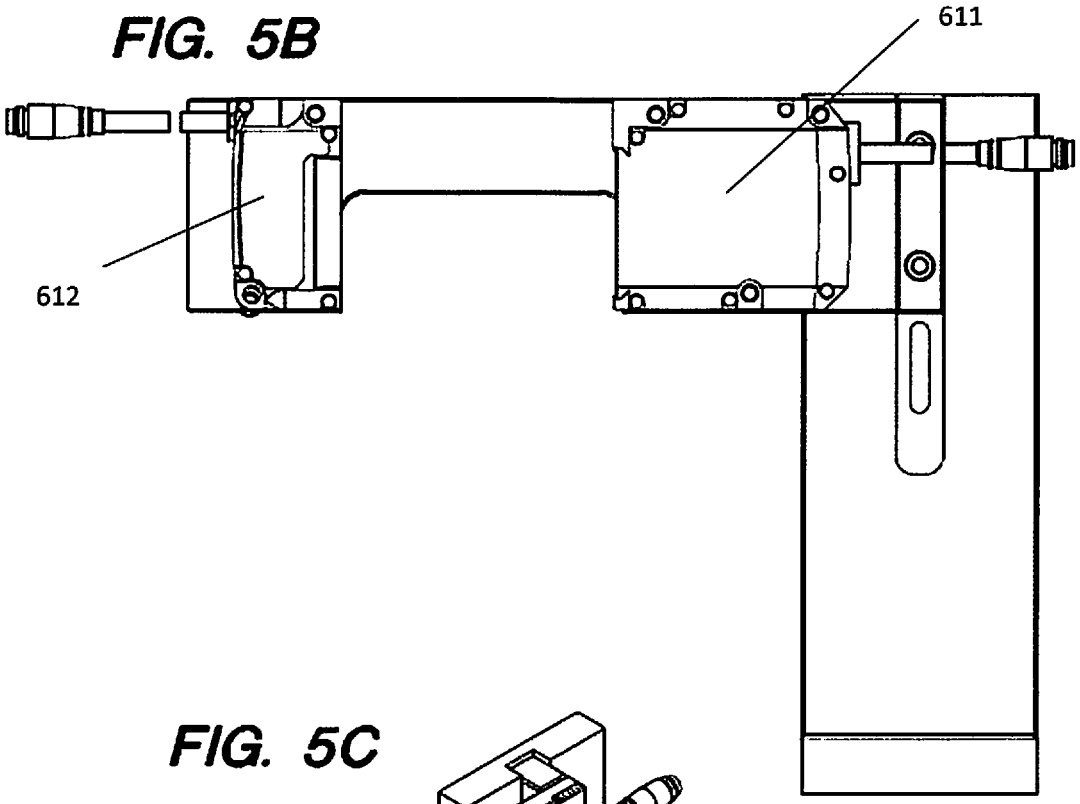
FIG. 5B is a side plan view of the laser OAL assembly.
Figure 5C:
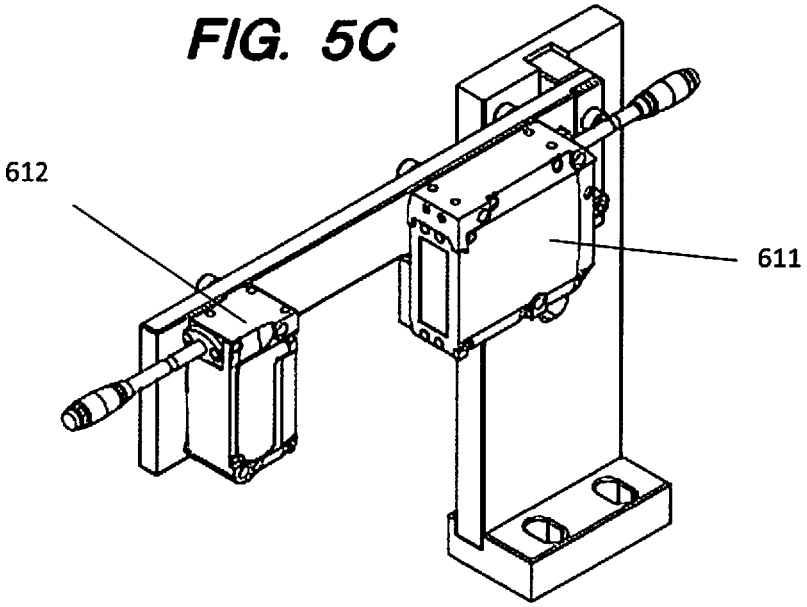
FIG. 5C is a perspective view of the laser OAL assembly.
Figure 6:
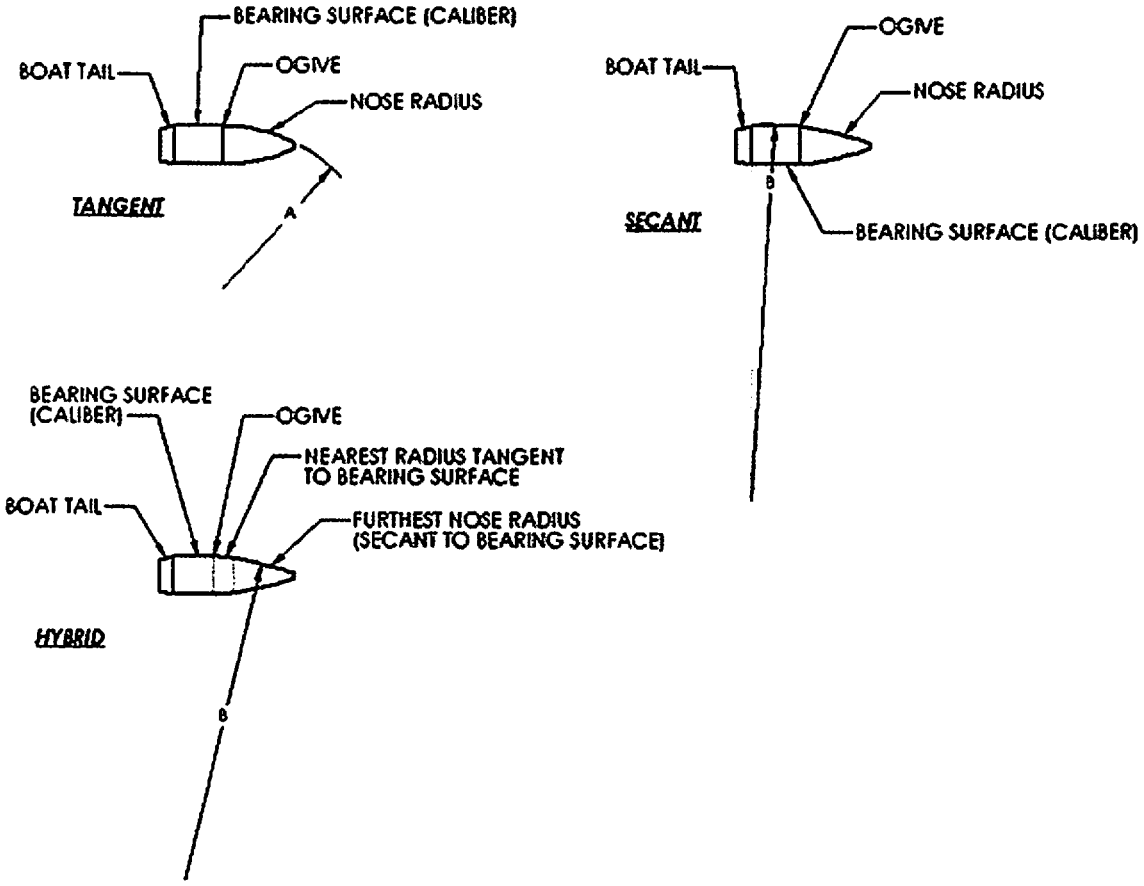
FIG. 6 (Prior Art)
FIG. 6 is a plan view of prior art tangent, secant, and hybrid bullet configurations.

Once the case 104 is crimped to the bullet 107 the loaded cartridge goes to the Process Control Station 600. The Process Control Station 600 is comprised of an OAL laser height check 601 (FIG. 3) and an ogive length check 602 (FIG. 4). Measuring a loaded cartridge 603 overall length (OAL) by laser micrometer is an industry standard. However, measuring to a specific point on the bullet 107 ogive 604 once installed has not been done in the production cartridge manufacturing process before. Different bullet configurations have different profiles depending on weight, length, composition and manufacturer as shown in FIG. 6. The actual shape of the bullet and length can vary even within the same lot number. The location of the ogive 604 to the base 605 of the bullet 107 stays much more uniform during the production process. And because the ogive 604 is the point where the radius on the nose 606 meets the outside full diameter of the bullet 107, it is a consistent contact point with the barrel rifling. By keeping this point consistent, the repeated firing stays more consistent while shooting. As such, consistency and precision of the ammunition loading is improved significantly.

Figure 7A:
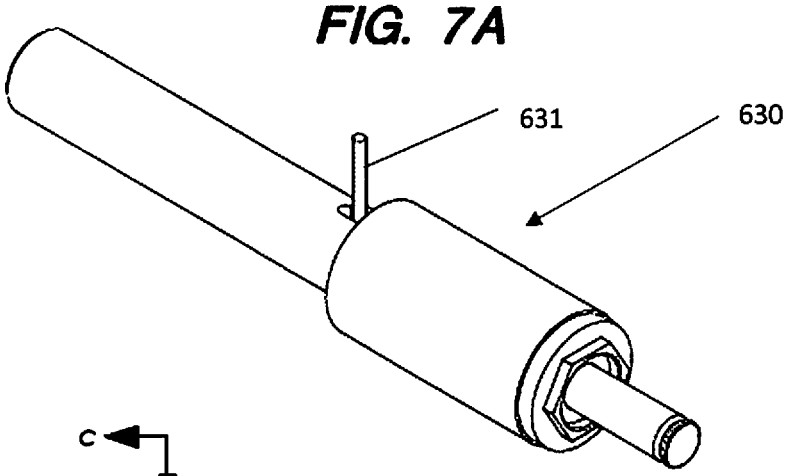
FIG. 7A is a perspective view of the ogive laser measurement seating tool.
Figure 7B:
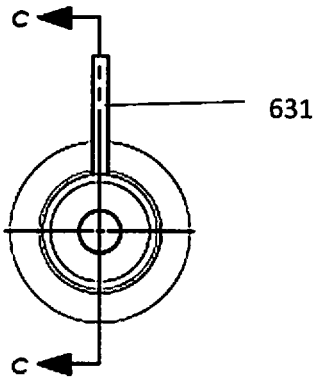
FIG. 7B is cross section view of the ogive laser measurement seating tool.
Figure 7C:
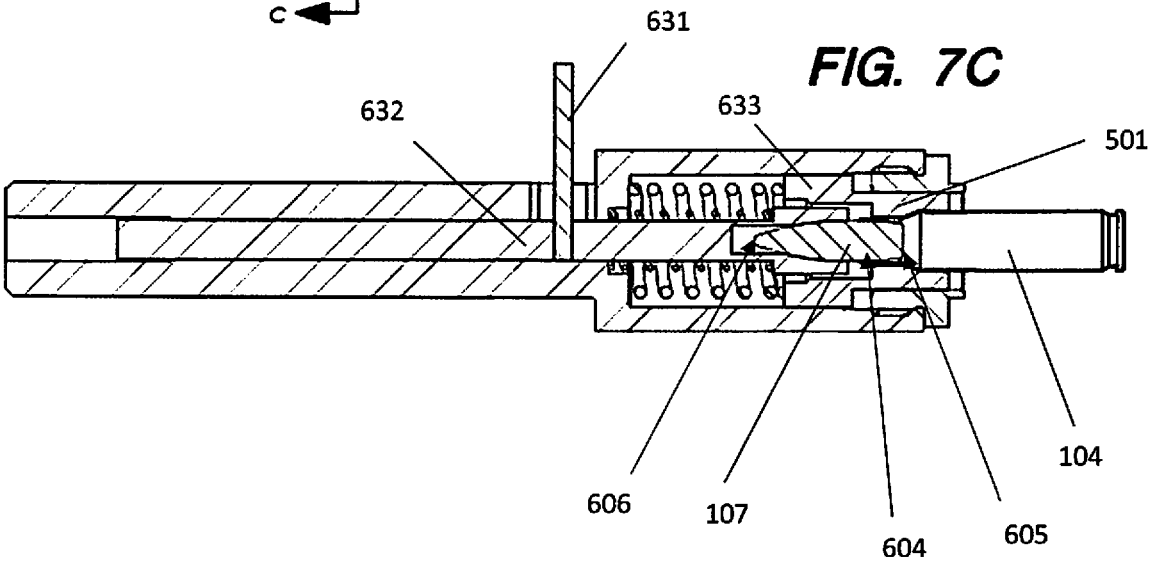
FIG. 7C is a longitudinal sectional view of the ogive laser measurement seating tool.
Figure 8:
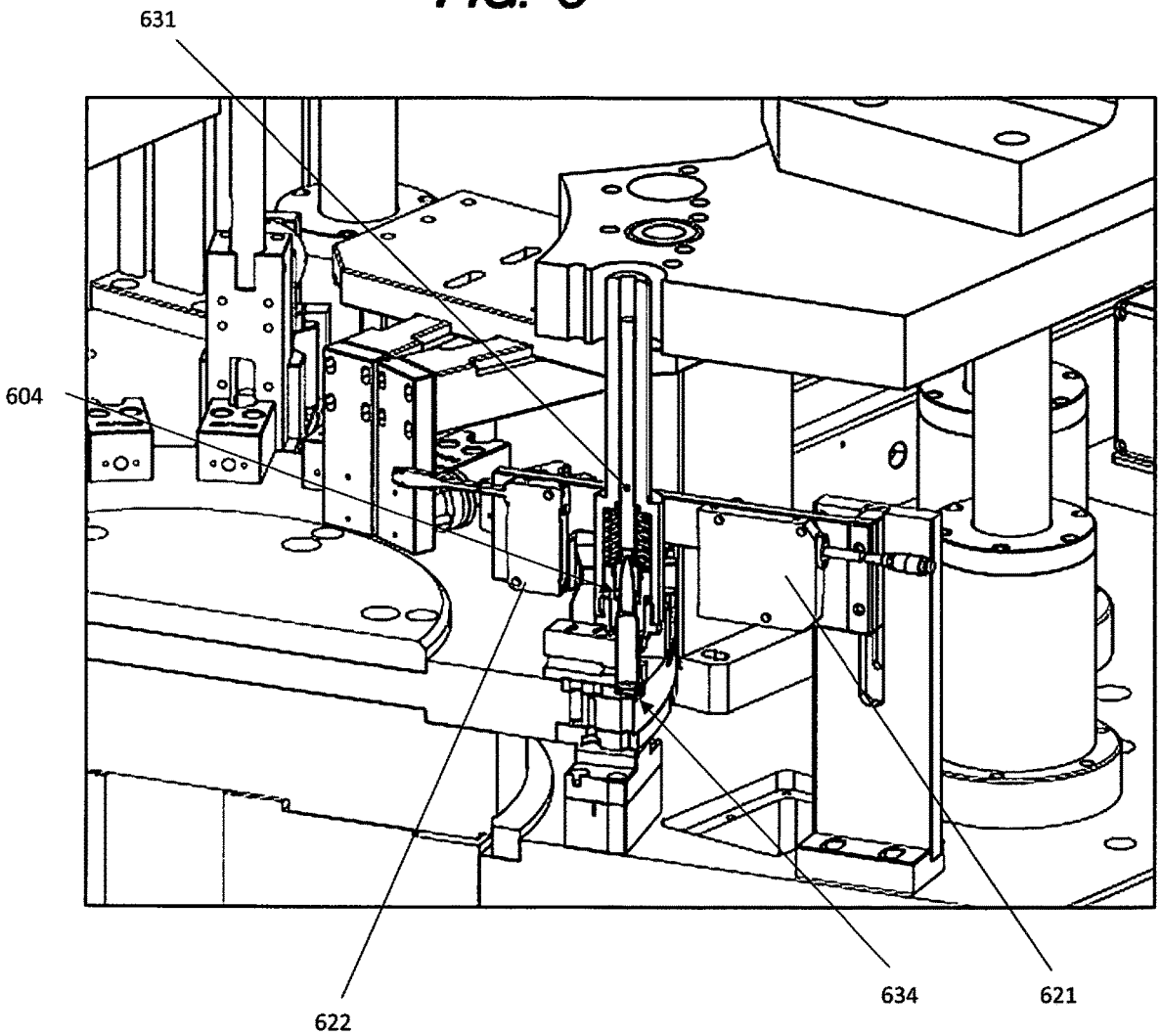
FIG. 8 is a perspective view of the ogive laser measurement tool within the machine.

Because the OAL of a cartridge is a fixed SAAMI or C.I.P. dimension, the Process Control Station 600 will measure the OAL at the OAL laser height check 601 which is further comprised of a first laser micrometer station 610 (see FIG. 3) comprised of a laser transmitter 611 and laser receiver 612, to make sure the OAL is within the tolerance of the published standard. The bullet 107 must be seated to a specific depth measured from the base 609 of the cartridge 603 and that seating depth is used to control both the volume available for powder in the case 104, and the length of the bullet 107 inserted into the case 104. As shown in FIG. 4, the ogive length check 602 is comprised of a second laser micrometer 620 comprised of a laser transmitter 621 and laser receiver 622, which is set to a specific location on the bullet's ogive 604 where it meets the requested bearing depth near the full diameter of the bullet. As shown in detail in FIG. 7 a spring-loaded tool 630 is set to keep this point consistent while loading and the OAL length within SAAMI or C.I.P. specifications. The spring-loaded tool 630 form fits the bullet 107 and contacts the same point on the bullet's ogive 604 for each round. The spring-loaded tool 630 is further comprised of a flag 631 (dowel pin) that will be mounted to the form fitting inner tool 632 that can be compared to a fixed case 104 base point 634 with a Keyence laser. The laser is accurate to within .003". The cartridge 603 will be held down to the bottom of the case insert 204 with a spring-loaded collar 633 as the inner tool 632 is lowered. By keeping the base point 634 fixed, the flag 631 location in relation to the base point 634 can be held more accurately and is used to monitor the bullet seat depth on each part for consistency.

By keeping the volume of powder and the bullet seating depth consistent in a single production run of cartridges it will provide a much more accurate and consistent cartridge for competition and long-range shooters. By locating to a fixed ogive location and keeping the overall length within the industry standard, the cartridges are more consistent and can be sold for a premium as "match grade" ammunition.

After the Process Control Station 600, the assembled cartridge 603 enters the Reject Station 700. At the Reject Station 700 an assembled cartridge is removed from the insert disk 210 prior to an Eject Station 800 by a pneumatic cylinder if the cartridge 603 OAL length and ogive length measurements are not within the specified tolerances set at the Process Control Station 600.

Any assembled cartridges 603, which pass the Reject Station 700 are moved to the Eject Station 800 where a pneumatically activated pusher removes the cartridge assembly from the insert disk 210 case insert 204. The completed cartridges 603 drop onto an internal mounted conveyor 801, which conveys the completed cartridges to a collection receptacle. The empty case insert 204 is now ready to receive the next empty case for loading.

It is understood that the foregoing examples are merely illustrative of the present invention. Certain modifications ofthe articles and/or methods may be made and still achieve the objectives of the invention. Such modifications are contemplated as within the scope of the claimed invention.

What is claimed is:

1. An ammunition production loading machine comprising:

A. A Case Load Station wherein empty cases are loaded into a removeable case insert of an insert disk;

B. A Powder Load Station wherein powder is delivered to said cases and said powder is measured by a physical powder sensor and a laser powder measuring check;

C. A Bullet Load Station wherein a bullet is loaded into each of said cases;

D. A Case Bullet Crimp Station comprised of an upper ram driven crimp tool, which crimps said bullets to said cases to form an assembled cartridge;

E. A Process Control Station comprised of an overall length laser height check comprised of a first laser micrometer and an ogive length check comprised of a tool, wherein said tool form fits said bullet and contacts an ogive of the bullet when said tool is lowered, and wherein a second laser micrometer measures a position of a flag of said tool with respect to a fixed base point of said cartridge;

F. A Reject Station, which will remove any assembled cartridge from said insert disk if said cartridge overall length and ogive length check measurements are not within a specified tolerance set at said Process Control Station;

G. A Eject Station wherein a pneumatically activated pusher removes said cartridges, which pass said Process Control Station onto an internal mounted conveyor;

wherein a motor drives a center mounted crankshaft with a chain, sprockets and clutch, which drives an upper and lower ram up and down to perform the functions of each of the machine's stations and said motor also drives a 24-position indexer, which rotates said insert disk through the machine's stations.

2. The ammunition production loading machine of claim 1, wherein said ogive length check second laser micrometer is further comprised of a laser transmitter and a laser receiver.

3. An ammunition production loading machine ogive length check comprising:

an overall length laser height check comprised of a first laser micrometer;

a tool, wherein said tool form fits a bullet and contacts an ogive of the bullet of a loaded cartridge when said tool is lowered; and wherein said tool is further comprised of a flag mounted to said tool, wherein a second laser micrometer measures a position of said flag with respect to a fixed cartridge base point.

* * * * *